United States Patent [19]

Alto et al.

[11] Patent Number: 5,009,131

[45] Date of Patent: Apr. 23, 1991

[54] ROOF SHINGLE STRIPPER APPARATUS

[76] Inventors: Brian J. Alto, 382 Morris Ave., A3, Summit, N.J. 07901; Gregory F. Alto, 68 Runnymeade Rd., Berkeley Heights, N.J. 07922

[21] Appl. No.: 519,406

[22] Filed: May 4, 1990

[51] Int. Cl.[5] ..... E04D 15/00

[52] U.S. Cl. ..... 81/45; 30/169; 299/37

[58] Field of Search ..... 81/45; 30/169, 170; 299/36, 37

[56] References Cited

U.S. PATENT DOCUMENTS

| | | | |
|---|---|---|---|
| 3,195,232 | 7/1965 | Toth | 30/169 |
| 4,091,535 | 5/1978 | Lehrter | 30/169 |
| 4,277,104 | 7/1981 | Sanchez | 30/169 X |
| 4,286,383 | 9/1981 | Farden | 30/169 |

*Primary Examiner*—James G. Smith

*Attorney, Agent, or Firm*—Bernard J. Murphy

[57] ABSTRACT

The apparatus has a housing which slidably mounts a blade assembly for reciprocation thereof, fore and aft, perpendicular to the longitudinal axis of the housing, for the purpose of cutting shingle nails. The blade assembly slides upon a plate, which terminates in a series of juxtapositioned teeth, which lifts shingles to give the blade assembly access to the nails. A prime mover, an electric motor in the disclosed embodiment, drives the blade assembly in reciprocation through a gear train and cranks confined within the housing. Vibration-induced, free-flow lubrication for the blade assembly is provided by a lubricant reservoir and manifold mounted upon the housing.

9 Claims, 3 Drawing Sheets

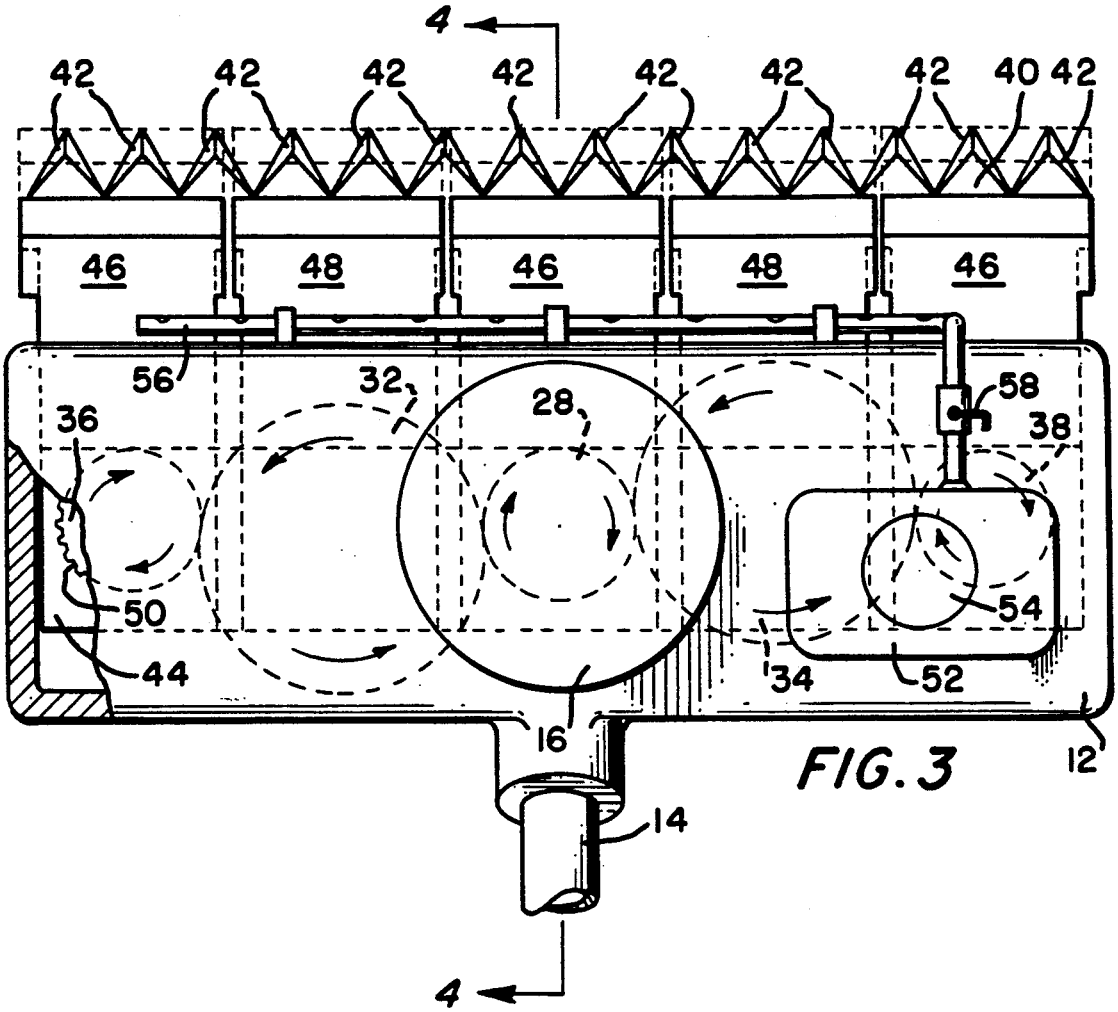
FIG. 3
FIG. 5
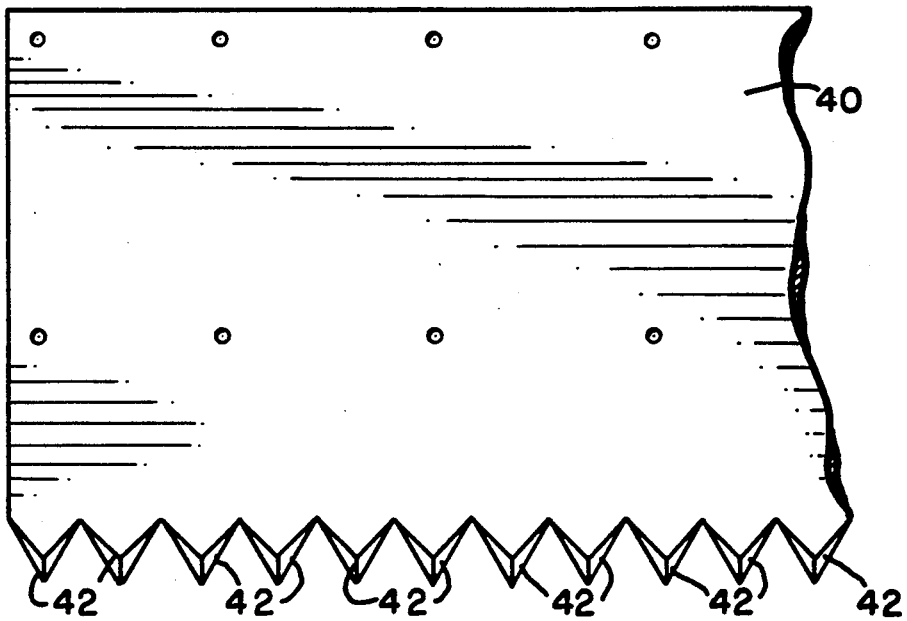

ROOF SHINGLE STRIPPER APPARATUS

This invention pertains to powered tools, such as are used in the construction industry, and in particular to a powered roof shingle stripper apparatus.

Commonly, when a house or other building has to be re-roofed, it is necessary to strip the existing roof therefrom. Now, such is a laborious undertaking. Each shingle has to be addressed, and its nails severed before the shingle itself can be removed and discarded. Even if the shingles are torn from their nails, the nails have to be cut or otherwise removed before a new course of shingles may be put in place.

What has been needed is a power tool of some sort which can address a number of juxtaposed shingles, lift them together, and sever the nails holding them automatically. In a word, a roof shingle stripper apparatus has long been needed, and it is an object of this invention to set forth just such an apparatus.

Particularly, it is an object of this invention to disclose a roof shingle stripper apparatus comprising a housing having a longitudinal axis; nail-cutting means slidably mounted in said housing, for movement, relative to said housing, perpendicular to said axis; and a prime mover, mounted to said housing and coupled to said means, for moving said means in such perpendicular movement.

Further objects of this invention, as well as the novel features thereof, will become more apparent by reference to the following description taken in conjunction with the accompanying figures, in which:

FIG. 3 is an enlarged, plan view of the housing, the same being partially cut away at one end thereof;

FIG. 5 is a plan view of just the shingle-lifter plate, and of just a portion thereof.

Figure 1:
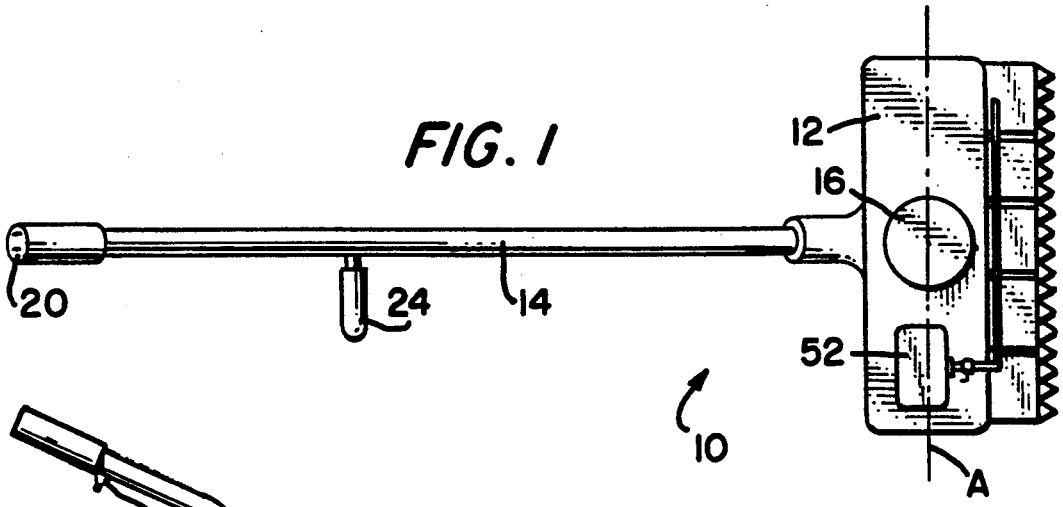
FIGS. 1 and 2 are plan and side elevation views, respectively, of the novel apparatus, according to an embodiment thereof.
Figure 2:
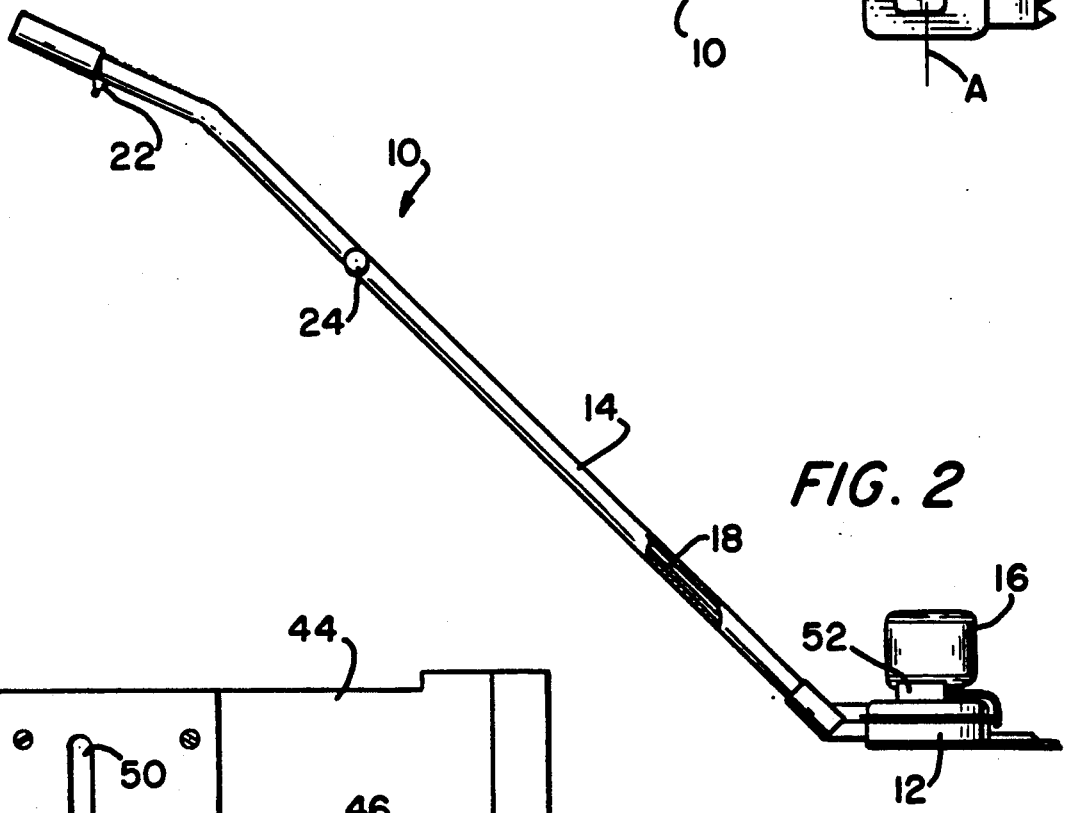
Figure 6:
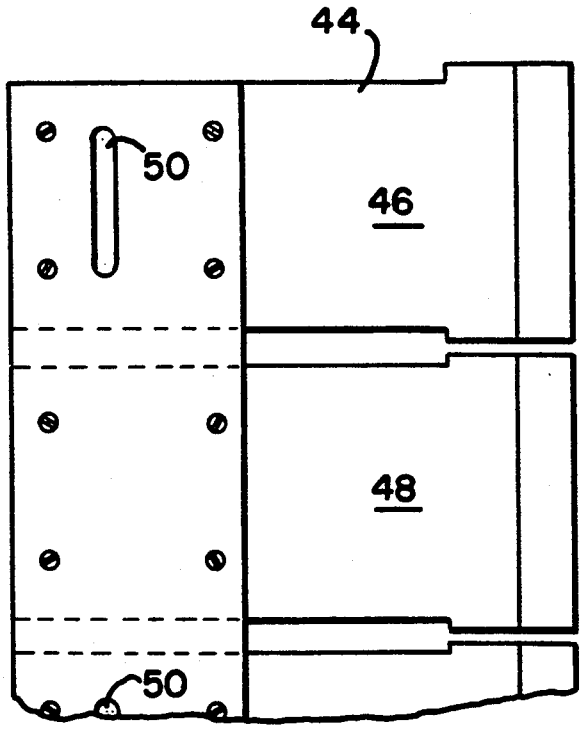
FIG. 6 is a plan view of just a portion of the nail-cutting blade assembly.
Figure 4:
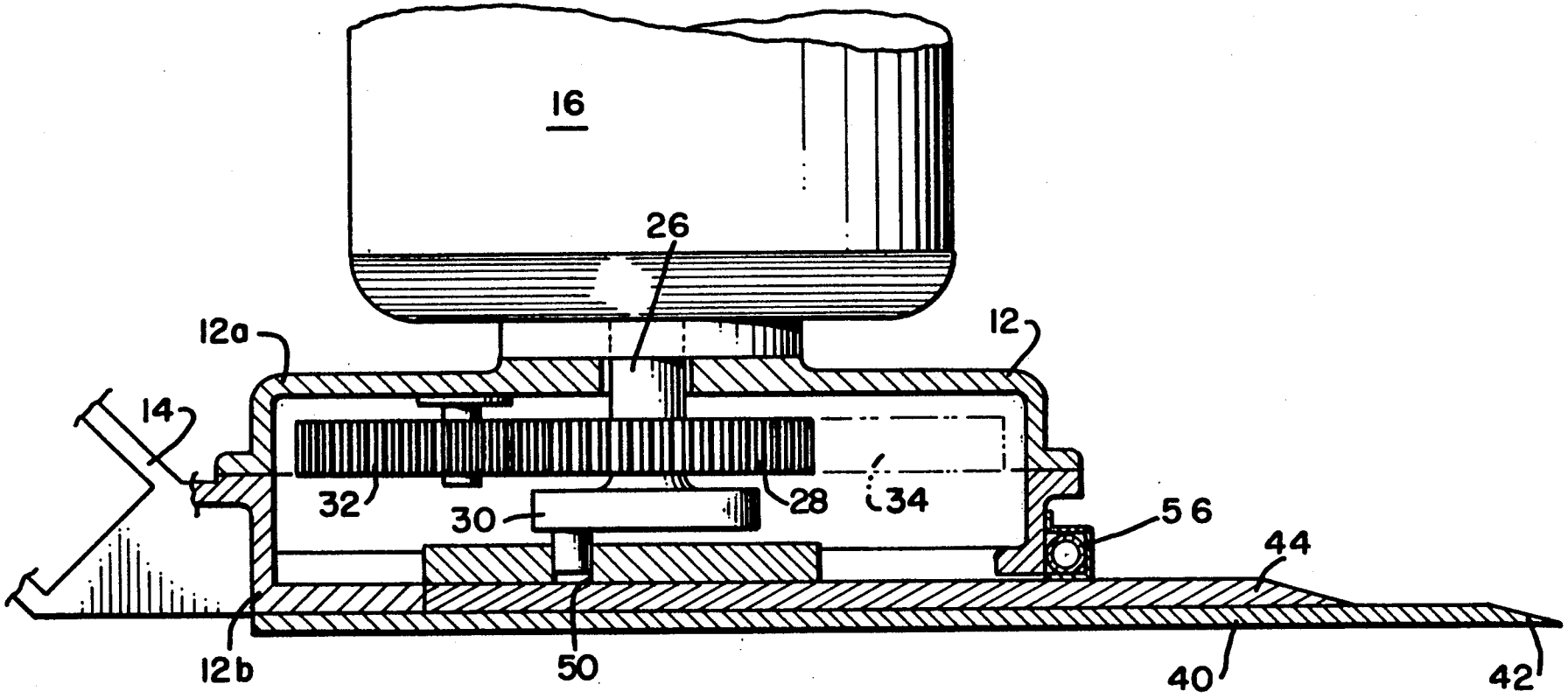
FIG. 4 is a cross-sectional view taken along section 4—4 of FIG. 3.

As shown in the figures, the novel apparatus 10, according to an embodiment thereof, comprises a housing 12 which is coupled an extended handle 14. An electric motor 16 is mounted atop the housing 12. The handle 14 is hollow to accommodate therewithin electrical lines 18 which terminate at the motor 16, at one end, and a electrical socket 20 at the opposite end, in the termimal end of the handle 14. A common on/off switch 22 is coupled to the handle 14, and electrically to the lines 18. Intermediate the length of the handle 14 is fixed a hand grip 24 for assistance in manipulating the apparatus 10.

Housing 12 comprises upper and lower shells **12*a* and 12*b*. The motor 16 is mounted to shell 12*a* and has a drive shaft 26 which extends into the housing 12. Shaft 26 mounts a drive gear 28 and the latter, in turn, mounts an offset crank 30. Gear 28 is in meshed engagement with a pair of idler gears 32 and 34 which are journalled in shell 12*a*. Too, idler gears 32 and 34 are in meshed engagement with a pair of driven gears 36 and 38; driven gears 36 and 38 are also journalled in shell 12*a* and, like gear 28, mount offset cranks (identical to crank 30**).

Fixed, i.e., immorably fastend, to the underside of shell **12*b* is a shingle-lifter plate 40. A portion of plate 40 extends from the housing 12**, along a side of the housing.

The extending portion terminates in a series of juxtaposed teeth 42. The latter are tapered, and serve to intrude under and between shingles to lift the same to facilitate the cutting of the nails therein.

Slidably supported in the housing 12 and guided by end walls of shell **12*b* is a blade assembly 44. Assembly 44 comprises a plurality (five in this embodiment) of replaceable cutting blades 46 and 48. Blades 48 (of which two are shown) are identical, and blades 46 (of which three are shown) are identical; they differ from blades 48 in that they have linear slots 50 formed therein in which to receive the cranks 30. As denoted by the arrows in FIG. 3, rotation of the drive gear 28 in a clockwise direction will cause driven gears 36 and 38 to rotate in synchoronism. Too, the cranks 30, working the slots 50, will cause the blade assembly 44 to reciprocate fore and aft perpendicular to the length of the housing 12 and its longitudinal axis "A". The assembly 44 slides upon the plate 40. The plate 40 lifts a series of shingles, and the assembly 44** shears the nails thereof.

The apparatus 10 has means for keeping the blade assembly 44 adequately lubricated. The housing 12, at one end thereof, mounts a reservoir 52. The reservoir 52, a hollow tank having a filler cap 54, confines lubricant therein. A manifold 56, which takes the form of a serially apertured pipe, is in fluid-flow communication with the reservoir 52 via a control valve 58. With the valve 58 in its open position, lubricant flows to and through the manifold 56, being induced by the vibration of the operating apparatus 10. The lubricant insinuates itself between the blades 46 and 48 and the underlying plate 40.

While we have described our invention in connection with a specific embodiment thereof, it is to be clearly understood that this is done only by way of example and not as a limitation to the scope of our invention, as set forth in the objects thereof and in the appended claims. For instance, while the embodiment depicted and described comprises an electric motor 16 and electrial lines 18 therefor, it will be appreciated that the prime mover could just as well be an air motor, and the hollow handle 14 can be the conduit for compressed air for powering such an air motor. Too, the motor 16 could be supplanted by an internal combustion engine. Simply, the source of power is not limiting of the invention. Also, the gear train could just as well be supplanted by a drive belt arrangement. These, and all other alterations and variations of the invention, which will occur to others, proceed from the disclosure herein and are deemed embraced by the claims.

We claim:

1. Roof shingle stripper apparatus, comprising:

a housing having a longitudinal axis;

nail-cutting means slidably mounted in said housing for movement, relative to said housing, perpendicular to said axis; and a prime mover, mounted to said housing and coupled to said means for moving said means in such perpendicular movement; further including means immovably fastened to said housing for lifting portions of shingles; wherein said nail-cutting means is slidably disposed upon said lifting means.

2. Roof shingle stripper apparatus, according to claim 1, wherein:

said lifting means comprises a flat plate;

said plate has a portion thereof projecting from a side of said housing; and said portion of said plate terminates in a series of juxtaposed teeth.

3. Roof shingle stripper apparatus, according to claim 1, wherein:

said prime mover comprise a gear train.

4. Roof shingle stripper apparatus, according to claim 1, further including: means carried by said housing for lubricating said nail-cutting means.

5. Roof shingle stripper apparatus, comprising:

a housing having a longitudinal axis;

nail-cutting means slidably mounted in said housing for movement, relative to said housing, perpendicular to said axis; and a prime mover, mounted to said housing and coupled to said means for moving said means in such perpendicular movement; wherein said prime mover comprises a gear train;

said gear train includes a drive gear, two driven gears, and two idler gears;

said idler gears are interposed between said drive gear and said driven gears; and said drive gear and said driven gears have offset cranks.

6. Roof shingle stripper apparatus, according to claim 5, wherein:

said cranks are drivingly engaged with said nail-cutting means.

7. Roof shingle stripper apparatus, according to claim 6, wherein:

said nail-cutting means comprises an assembly of replaceable cutting blades;

a plurality of the blades of said assembly have linear slots formed therein; and said cranks are slidably engaged with said slots.

8. Roof shingle stripper apparatus, according to claim 7, further including:

means carried by said housing for lubricating said assembly of blades.

9. Roof shingle stripper apparatus, according to claim 8, wherein:

said lubricating means comprises (a) a reservoir mounted on said housing, and (b) a manifold supported on said housing, in close proximity to said assembly of blades, in fluid-flow communication with said reservoir.

* * * * *